United States Patent [19]

Hayes

[11] 4,353,506

[45] Oct. 12, 1982

[54] POP-UP SPRINKLER

[75] Inventor: Jerry R. Hayes, Peoria, Ill.

[73] Assignee: L. R. Nelson Corporation, Peoria, Ill.

[21] Appl. No.: 187,445

[22] Filed: Sep. 15, 1980

[51] Int. Cl.[3] ..... B05B 3/04; B05B 3/08

[52] U.S. Cl. ..... 239/206; 239/231; 239/247; 239/513; 239/DIG. 1

[58] Field of Search ..... 239/203–206, 239/231, 237, 240, 241, 246, 247, 505, 498, 509–513, DIG. 1

[56] References Cited

U.S. PATENT DOCUMENTS

| | | | |
|---|---|---|---|
| Re. 23,646 | 4/1953 | Burdick | 299/61 |
| 1,881,409 | 10/1932 | Le Moon . | |
| 2,221,878 | 11/1940 | Nelson | 299/61 |
| 2,414,052 | 1/1947 | Martin | 299/18 |
| 2,756,099 | 7/1956 | Reynolds | 299/61 |
| 2,909,325 | 3/1959 | Hunter | 239/97 |
| 3,131,867 | 5/1964 | Miller | 239/97 |
| 3,515,351 | 6/1970 | Costa | 239/206 |
| 3,580,514 | 5/1971 | Radecki | 239/521 |
| 3,724,757 | 4/1973 | Hunter | 239/205 |
| 3,791,581 | 2/1974 | Chow | 239/205 |
| 3,854,664 | 12/1974 | Hunter | 239/206 |
| 3,915,383 | 10/1975 | King | 239/242 |
| 3,921,191 | 11/1975 | Hayes | 239/205 |
| 3,977,063 | 8/1976 | Bruninga | 29/157 |
| 4,220,283 | 9/1980 | Citron | 239/205 |

*Primary Examiner*—Andres Kashnikow

*Attorney, Agent, or Firm*—Cushman, Darby & Cushman

[57] ABSTRACT

A pop-up sprinkler assembly of the type including an internally driven rotary sprinkler head having a multiplicity of annularly spaced flow passages through which the flow of water is controlled by a fixed pattern plate. The assembly is provided with a manually operable pattern plate mounting member for adjusting the fixed cooperating relationship of the pattern plate with the rotary sprinkler head so that the orientation of the ground pattern area within which the water streams fall can be easily determined.

22 Claims, 11 Drawing Figures

Fig. 7.
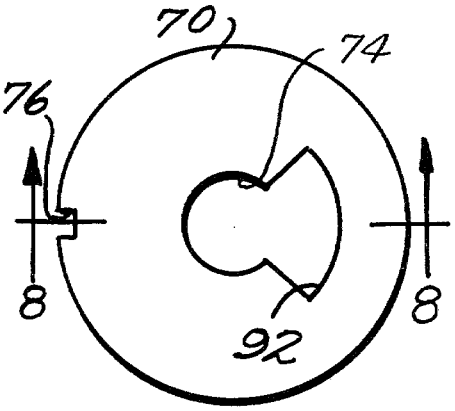
Fig. 8.
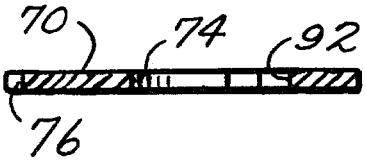
Fig. 9.
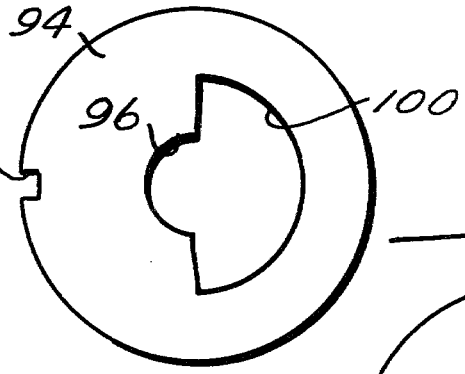
Fig. 10.
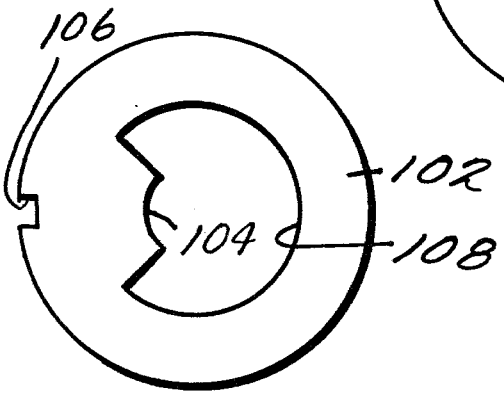
Fig. 11.
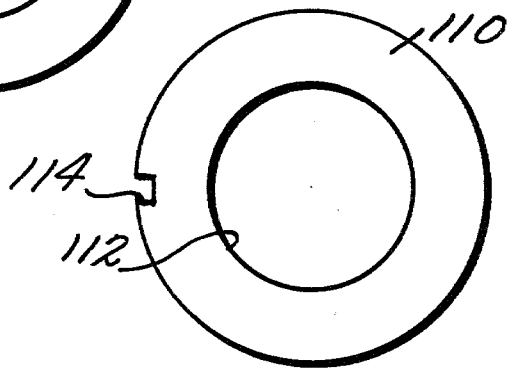
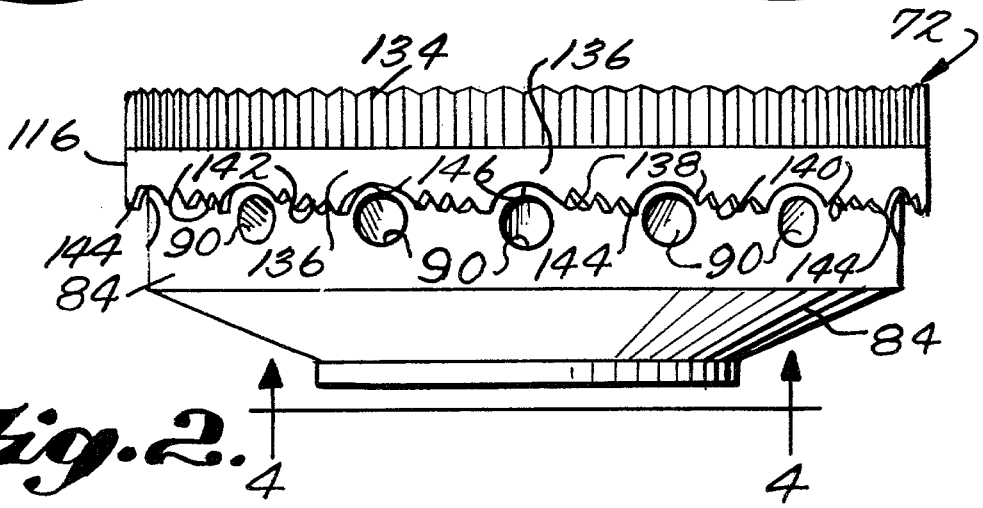
Fig. 2.

POP-UP SPRINKLER

This invention relates to sprinklers and more particularly to improvements in sprinklers of the pop-up type.

Pop-up sprinklers are well known and find their greatest use in lawn watering systems. An important consideration with respect to pop-up lawn sprinkler systems is that a standard sprinkler must be capable of selectively providing either full circle or part circle sprinkling patterns. Part circle requirements include quarter circle patterns for inside corners, three-quarter circle patterns for outside corners and half circle patterns for borders, side walks and the like.

Two types of sprinkler heads are commonly employed in pop-up sprinklers. One type is the impact sprinkler head, in which case full or part circle capability is provided through simple adjustment of the standard part circle mechanism (see commonly assigned U.S. Pat. No. 3,977,063). A pop-up sprinkler assembly which embodies an impact sprinkler head is advantageous because it has a relatively high capacity with the capability of covering a vastly larger pattern area than its instantaneous pattern through the step-by-step movement of the instantaneous pattern. However, a disadvantage of the utilization of an impact sprinkler head in a pop-up sprinkler assembly is that the housing for the pop-up sprinkler head must of necessity be fairly large. Such large size is a disadvantage with respect to cost and to some extent with respect to appearance.

The other type of sprinkler head embodied in pop-up sprinkler assemblies is a spray head (see commonly assigned U.S. Pat. No. 3,921,910). In this case, full or part circle capability is usually provided by the initial selection of one of a plurality of different pattern producing elements. By utilizing a spray head in a pop-up sprinkler, size can be minimized, thus reducing cost and enhancing the appearance factor. Spray head sprinklers, however, have a relatively limited capacity in that the total spray pattern is equal to the instantaneous spray pattern since movement of the instantaneous spray pattern is not contemplated.

There have been many attempts to provide pop-up sprinkler assemblies with movable spray heads which are minimized in size. It is well known that one way of diminishing the size requirements is to provide an internal drive mechanism operable by the flow of water under pressure through the sprinkler housing to effect a rotational movement of the spray nozzle or nozzles. A particularly desirable internal drive mechanism is disclosed in each of the following commonly assigned U.S. patents: No. 3,915,383; and No. 3,921,910. Where an internal drive mechanism is utilized in a pop-up sprinkler assembly, it is also necessary to provide the resultant assembly with either full circle or part circle capability. One known manner of achieving such capability with internal drive mechanisms is to provide the rotary head which is driven by the internal drive mechanism with a multiplicity of separate annularly spaced orifices. The pattern is then determined by the initial selection of one of a plurality of different pattern plates operable to block the flow of water to certain of the orifices during the movement of the rotary head. An early example of a pop-up internally driven spray pattern plate type assembly is disclosed in U.S. Pat. No. 3,131,867. A more recent version is disclosed in U.S. Pat. No. 3,854,664.

While pop-up sprinkler assemblies of the type described above have proven satisfactory in operation, there are disadvantages which it would be desirable to eliminate. One such disadvantage is presented during installation because of the necessity to orient the selected part circle pattern plate of the sprinkler assembly with respect to the ground. In the patented arrangements it is necessary to orient the housing of the pop-up assembly in order to achieve proper orientation of the part circle pattern plate because the pattern plate is effectively keyed to the housing. This presents a difficulty because the housing must be threaded to a ground imbedded riser pipe in such a way as to secure a water tight connection. Thus, the problem is presented because an effective water tight seal cannot always be secured in any 360° position of rotational adjustment that may be required to properly orient the part circle pattern plate.

Accordingly it is an object of the present invention to provide a pop-up sprinkler assembly of the type described which obviates the installation disadvantage with respect to the orientation of a part circle pattern plate noted above. In accordance with the principles of the present invention this objective is obtained by providing a separate member which serves to mount the pattern plate in operative relation with respect to the rotary plural orifice spray head. This plate mounting member is rotatably mounted within the pop-up structure so as to be manually adjustable for rotational movement into any desired operative position. Preferably, the arrangement is such that the adjustment can be manually accomplished during the operation of the sprinkler assembly. Preferably the plate mounting member is mounted for rotational movement in sealing relation with respect to the pop-up structure, such sealing relation being achieved by mechanical deformation of a resilient O-ring seal, such resilient deformation serving to provide for yieldably maintaining the plate mounting member in its selected operative position.

Another desirable feature which is lacking in the multiple orifice internally driven rotary sprinkler heads of the prior art patents noted above is the capability of adjusting the water stream delivered by each orifice. While adjustments of this type are known per se, see for example, U.S. Pat. No. 3,580,514, the provision of such a means in the particular type of pop-up sprinkler presents particular problems requiring a particular solution.

It is another object of the present invention to provide a pop-up sprinkler assembly having a multiple orifice internally driven rotary spray head with improved means for adjusting the water stream issuing from the multiple orifices of the spray head thereof. In accordance with the principles of the present invention this objective is obtained by providing an annular stream adjusting member in a position above the rotary head, the annular member having a peripheral skirt formed with a series of different depending stream entering projections for each orifice and means for adjustably indexing the annular member into a series of different positions of operative adjustment corresponding to the different series of projections provided whereby the extent of interruption of the stream issuing from each of the plural orifices can be varied depending upon the selected position of operative adjustment of the annular member.

Another object of the present invention is the provision of a sprinkler of the type described which is simple in construction, effective in operation and economical to manufacture.

These and other objects of the present invention will become more apparent during the course of the following detailed description and appended claims.

The invention may best be understood with reference to the accompanying drawings, wherein an illustrative embodiment is shown.

In the drawings:

FIG. 2 is a front elevational view of the rotary sprinkler head of the pop-up sprinkler assembly shown in FIG. 1;

FIG. 7 is a top plan view of a quarter circle pattern plate;

FIG. 8 is a sectional view taken along the line 8—8 of FIG. 7;

FIG. 9 is a view similar to FIG. 7 showing a half circle pattern plate;

FIG. 10 is a view similar to FIG. 7 showing a three-quarter circle pattern plate; and FIG. 11 is a view similar to FIG. 7 showing a full circle pattern plate.

Figure 1:
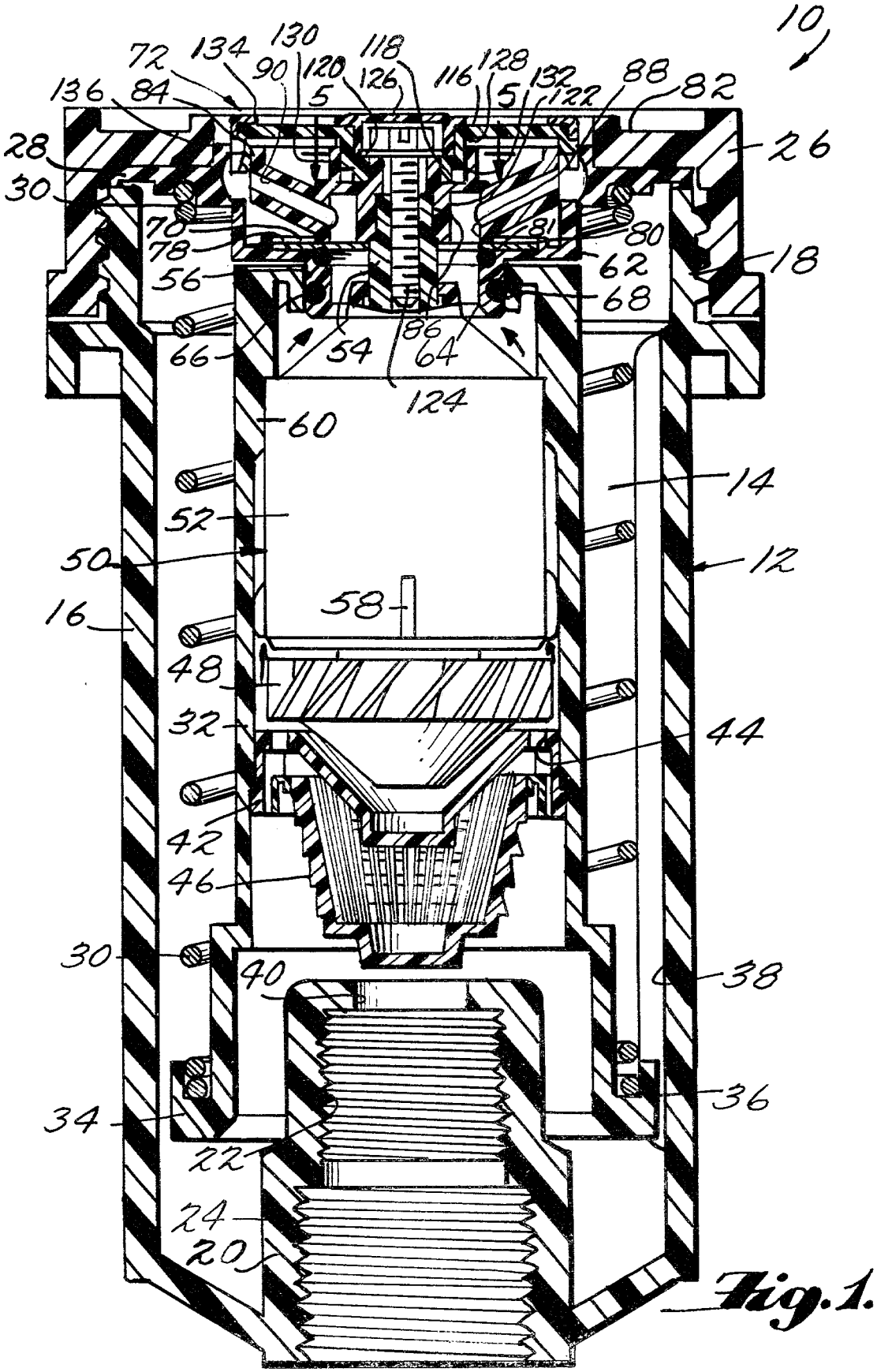
FIG. 1 is a vertical sectional view of a pop-up sprinkler assembly embodying the principles of the present invention.

Referring now more particularly to the drawings, there is shown in FIG. 1 a pop-up sprinkler assembly, generally indicated at 10. The assembly 10 includes a fixed housing structure, generally indicated at 12, adapted to be imbedded within the ground and to be communicated with a source of water under pressure and a pop-up sprinkler head structure, generally indicated at 14, which is mounted within the housing structure 12 for movement from an inoperative position within the housing structure, as shown in FIG. 1, into an elevated operative position in response to the communication of a source of water under pressure with the housing structure 12.

The construction of the housing structure 12 and the manner in which the pop-up sprinkler head structure 14 is mounted therein is preferably in accordance with the teachings contained in the aforesaid U.S. Pat. No. 3,921,910, the disclosure of which is hereby incorporated by reference into the present specification. Briefly, it will be noted that the housing structure 12 includes a main housing member 16 of generally cylindrical configuration having an exteriorly threaded upper annular portion 18 and an interiorly threaded interior lower annular portion 20. As shown, the lower portion 20 includes upper and lower sections having internal threads 22 and 24 of different size which serve to selectively connect with riser pipes of different size through which the source of water under pressure is communicated with the interior of the housing structure 12. The housing structure 12 also includes an upper end cap housing member 26 which is internally threaded to cooperatively engage the externally threaded upper portion 18 of the main housing member 16.

Mounted within the cap housing member 26 in fixed relation by virtue of the engagement of the upper edge of the housing member 16 therewith is an annular seal 28 which is constructed in accordance with the teachings contained within the U.S. Pat. No. 3,921,910. The annular seal 28 provides a downwardly facing annular seat for the upper end of a coil spring 30 which extends downwardly within the interior of the housing member 16.

The pop-up sprinkler head structure 14 includes a main piston member 32 of generally hollow cylindrical configuration having an exterior upturned flange portion 34 formed on the lower end thereof for receiving the lower end of the coil spring 30. The flange 34 includes a plurality of annularly spaced radially projecting key portions 36 which ride within three annularly spaced vertically extending keyways 38 formed within the interior periphery of the housing member 16 so as to restrict the vertical movement of the piston member 32 to rectilinear or pure reciprocating movement.

Mounted within the lower end of the hollow interior of the cylindrical piston member 32 in a position to receive water under pressure from a central inlet opening 40 in the housing portion 20 is a swirl imparting member 42. The swirl imparting member 42 includes a plurality of annularly spaced swirl imparting flow passages 42 extending therethrough for receiving water flowing through the inlet 40 and direct the same therethrough in an angular direction so that the water issuing from the flow passages 44 has a swirling motion about the longitudinal axis of the piston member. The central portion of the swirl imparting member 42 is of depending frustoconical configuration so as to direct the incoming water under pressure into the lower ends of the swirl imparting flow passages 44. Preferably, a frustoconical strainer member 46 is mounted between the inlet 40 and the swirl imparting member 42 to screen out particles in the water which would tend to clog the flow passages 44.

The swirling motion of the water passing through the member 42 serves to rotate an impeller member 48 which forms a part of an internal drive mechanism, generally indicated at 50, constructed in accordance with the teachings contained within the aforesaid commonly assigned U.S. Pats. No. 3,915,383 and No. 3,921,912, both of which are hereby incorporated by reference into the present specification.

The internal drive mechanism 14 includes a casing 52 which houses a gear reduction mechanism (not shown) driven by the impeller 43 through permanent magnets or a direct coupled shaft (not shown). The gear reduction mechanism includes an output shaft 54 which extends outwardly of the casing 52 upwardly through a central opening in the upper end of the piston member 32 defined by an interior cylindrical surface 56. It will be noted that the casing 52 of the drive mechanism is positioned within the piston member 32 so as to provide for the flow of water under pressure upwardly between the exterior periphery thereof and the interior periphery of the piston member. As shown, the mounting arrangement includes radially projecting ribs 58 on the exterior of the casing 50 and interiorly projecting ribs 60 on the interior periphery of the piston member 32.

In accordance with the principles of the present invention there is rotatably adjustably mounted within the open upper end of the piston member 32, a pattern plate mounting member 62 which has a frictionally yieldable relationship with respect to the cylindrical surface 56. As shown, the mounting member 62 includes a depending cylindrical flange portion 64 which is rotatably disposed within the cylindrical surface 56. Formed on the exterior periphery of the flange portion 64 is an annular groove 66 within which is mounted a resilient O-ring member 68. O-ring member 68 is of an exterior diameter greater than the interior diameter of the cylindrical surface 56 so as to be compressed radially inwardly when in engagement with the cylindrical surface. The compressed relationship of the resilient O-ring member 68 serves to provide the frictionally yieldable rotating movement of the mounting member 62 with respect to the rotationally fixed piston member 32.

In this way the mounting member 62 is normally frictionally retained in a rotationally fixed operative position so as to mount a pattern plate 70 in operatively fixed relation to a rotating sprinkler head, generally indicated at 72, fixed to the upper end of the output shaft 54. As best shown in FIGS. 7 and 8, pattern plate 70 is of thin circular configuration and includes a central opening 74 of a size to receive the shaft 54 therethrough. The pattern plate 70 also includes a notch 76 in the exterior periphery thereof which is adapted to receive therein a projection 78 formed on the upwardly facing portion of the mounting member 62 which serves to receive the pattern plate 70. Preferably, the mounting member 62 includes an upstanding rim portion 80 which serves to peripherally confine the pattern plate 70 when mounted on the mounting member in operative position. An annular seal member 81 is mounted within a suitable annular groove in the juncture between the depending flange portion 64 and central annular portion of the mounting member 62 so as to sealingly engage the under side of the pattern plate at a predetermined annular position thereon.

The mounting member 62 also includes a manually engageable peripheral portion 82 which extends upwardly from the periphery thereof. Preferably, the exterior periphery of the manually engageable portion 82 is provided with a slightly roughened or pebbly exterior surface suitable to provide a friction surface for facilitating the manual turning of the mounting member 62 while at the same time providing a temporary sealing surface for the interior of the sealing member 28.

Figure 4:
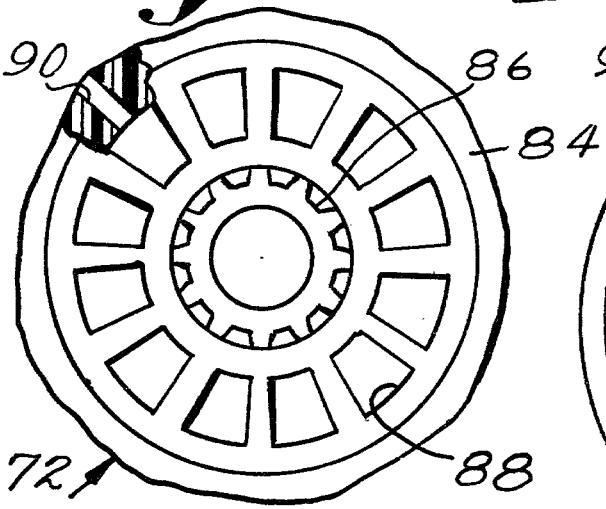
FIG. 4 is a fragmentary bottom view taken along the line 4—4 of FIG. 2 with certain parts broken away for purposes of clearer illustration.

Referring now more particularly to FIGS. 2–6, the rotary head 72 includes a rotary head member 84 having a central downwardly facing interiorly splined shaft engaging socket portion 86. The socket portion 86 is configured to be fixed to the upper end of the output shaft 54 which is provided with cooperating exterior splines. The head member 84 includes a multiplicity of annularly spaced water inlets 88. As best shown in FIG. 4 there are 12 inlets provided, each being of generally frustosegmental configuration and each extending upwardly from the lower surface of the member 84. Each inlet 88 constitutes the inlet end of a flow passage extending through the rotary head member 84, the outlet end of which is defined by an upwardly and outwardly extending outlet 90.

Figure 6:
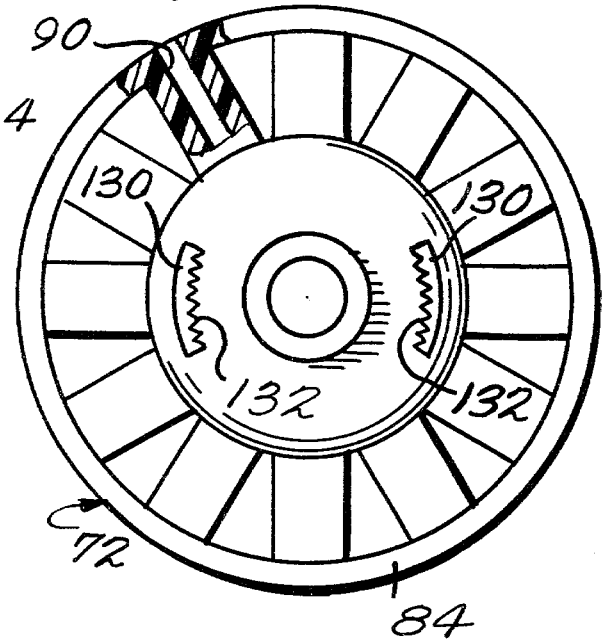
FIG. 6 is a top plan view partly in section of the rotary head member.
Figure 5:
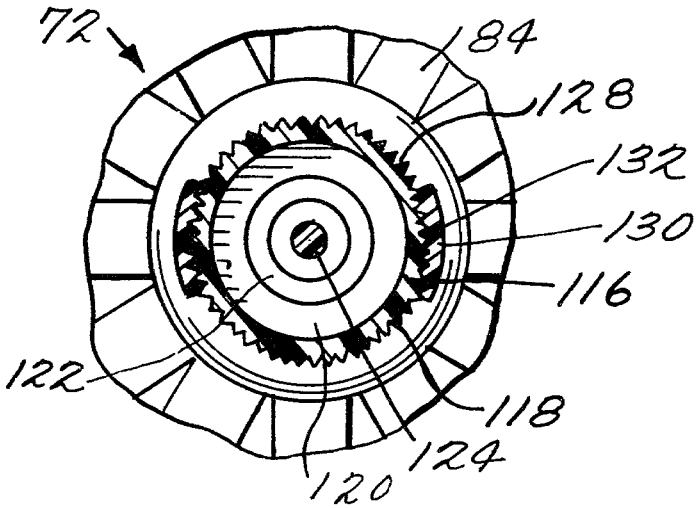
FIG. 5 is a fragmentary sectional view taken along the line 5—5 of FIG. 1.

As best shown in FIGS. 1, 4 and 6, each outlet 90 communicates at its inner end with the associated inlet 88 and extends upwardly and outwardly to the exterior periphery of the rotary head member 84 so as to define a water stream which issues therefrom in an upwardly and outwardly direction. In this way the rotary sprinkler head member 84 provides for the issuance of 12 annularly spaced water streams from the exterior periphery thereof. Pattern plate 70 serves to selectively block off the flow of water under pressure to selected inlets 88 so that the streams issuing from the outlets will fall within a predetermined ground pattern area. As shown in FIG. 7, an annular band of the pattern plate 70 which is radially outwardly of the opening 74 and has a radial extent equal to the radial extent of the inlets 88 (i.e. radially inward of seal 81) is formed with a frustosegmental opening 92. In the quarter circle pattern plate 70 shown in FIG. 7, the arcuate extent of the segmental opening 92 is approximately 85°.

FIG. 9 illustrates a half circle pattern plate 94 which includes central openings 96 for receiving output shaft 54, peripheral notch 98 for receiving the projection 78 and a segmental opening 100 within a similar annular band which has an arcuate extent of approximately 175°.

A three-quarter circle pattern plate 102 is illustrated in FIG. 10. The plate 102 includes a central opening 104 for receiving the shaft 54 and peripheral notch 106 for receiving the projections 78. A segmental opening 108 similar to the segmental openings 92 and 100 is provided which has an arcuate extent of approximately 265°.

FIG. 11 illustrates a full circle pattern plate 110 which includes a central circular opening 112 of a size equal to the exterior diameter of the bands previously noted. A peripheral notch 114 similar to the notches 76, 98 and 106, is also provided.

The rotary sprinkler head 72 in addition to the rotary head member 84 also includes a stream modifying cap member 116. Member 116 includes a central depending hub portion 118 which includes an interior upwardly facing shoulder 120. The rotary head member 84 includes a central upstanding cylindrical portion 122 of a size to receive the lower end of the depending hub portion 118 of the cap member. As best shown in FIG. 1, the interengagement of the portions 118 and 122 serves to mount the cap member 116 on the rotary head member 84 for rotational movement about the axis of rotation of the shaft 54 and rotary head member 84. A bolt and washer assembly 124 serves the dual purpose of retaining the rotary head member in fixed relation on the end of the output shaft 54 and the cap member on the rotary head member for independent rotation, as aforesaid. Preferably, a cover member 126 is snapped onto the central portion of the cap member to cover the head of the bolt 124 so as to protect the same and to enhance the appearance of the assembly.

Cap member 116 in addition to the rotary mounting thus far described is mounted with respect to the head member 84 for incremental indexed rotary movement as well. To this end, the upper exterior periphery of the depending hub portion 118 is formed with a multiplicity of serrations 128 of V-shaped cross-sectional configuration. Head member 84 is formed with a pair of annularly spaced integral yieldable indexing portions 130 extending upwardly therefrom in a position adjacent the periphery of the hub portion 118 of the cap member. As shown, the interior surface of each indexing portion 130 is serrated, as indicated at 132, so as to cooperatively engage the serrations 128 on the hub portion of the cap member.

The upper exterior and outer periphery of the cap member 116 includes manually engageable serrations 134 which provide a means for facilitating the incremental indexed rotational movements of the cap member 116 with respect to the rotary head member 84. It will be understood that by manually gripping the serrations 134, the operator is able to effect incremental indexed rotary movements of the cap member 116 with respect to the rotary head member 84.

Figure 3:
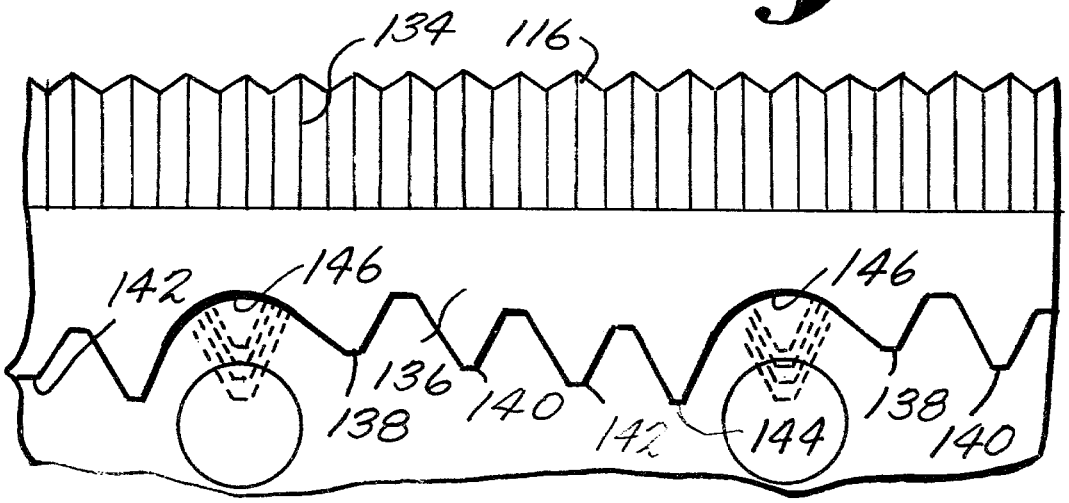
FIG. 3 is an enlarged fragmentary front elevational view of the sprinkler head shown in FIG. 2.

As best shown in FIGS. 2 and 3, the cap member 116 includes a depending annular skirt portion 136. The lower periphery of the skirt 136 is formed with a plurality of sets of stream engaging depending integral elements 138, 140, 142 and 144. The number of sets of depending elements provided is equal in number to the number of outlets 90 formed in the rotary head member 84 and their annular spacing is generally equal to the annular spacing of the outlets 90. As is clearly shown in FIG. 3, the vertical extent of the depending elements in each set is progressively greater and the angular spacing between each element of each set is equal to the angular spacing of the serrations 128 and 132 or one incremental indexed movement. Associated with each set of depending elements is a notch 146 which, as shown in FIG. 3, is positioned when aligned with an associated outlet 90 so as to be out of the path of movement of a stream issuing upwardly and outwardly of the outlet. It will also be noted that when the notch 146 of one set is angularly aligned with its associated outlet 90, the notches 146 of the other sets of stream modifying elements are angularly aligned with the other outlets 90. By manually moving the cap member 116 one incremental indexed movement, the shortest depending element 138 of each set is brought into angular alignment with an associated outlet. The shortest element 138 thus engages or penetrates into the stream issuing from the aligned outlet 90 from above only a short distance so as to provide a minimum amount of stream deflection. By moving the cap member 116 another incremental indexed movement, the next stream modifying element 140 of each set is brought into angular alignment with an associated outlet 90 so as to provide a greater amount of stream deflection. Similarly, when the cap member 116 is moved another incremental indexed movement, the next stream modifying element 142 of each set is brought into angular alignment with an associated outlet so as to provide a still further increase in the stream deflection. Finally, an additional incremental indexed movement serves to move the longest element 144 of each set into angular alignment with an associated opening so as to provide maximum stream deflection. In this way with the construction illustrated there are four progressively greater stream deflections which can be obtained by four incremental indexed movements of the cap member 116 with a fifth incremental indexed movement providing for stream integrity without deflection. The arrangement is such as to achieve stream modification simultaneously with all 12 streams associated with all 12 outlets 90. Once the adjustment is made the stream modification occurs during all rotational positions of the rotary sprinkler head 72.

FIG. 1 illustrates the spring biased inoperative position of the pop-up sprinkler head structure 14 with respect to the housing structure 12 when there is no water under pressure communicated with the inlet 40 of the housing structure. As important aspect of the present invention is the convenience which is afforded the operator during the installation of the assembly 10 within the ground in a conventional system used for watering a lawn. It will be understood that a system of this type requires the installation of feeder pipes under the ground which have supply pipes rising therefrom to which the pop-up sprinkler assemblies of the system are to be mounted. The pop-up sprinkler assemblies which are mounted along the periphery of the lawn are usually provided with part circle pattern plates, while those mounted in the central portion of the lawn are provided with circular pattern plates. With respect to the installation of an assembly with a full circle pattern, there is no problem presented with respect to the orientation of the pattern on the ground, since the pattern is symmetrical with respect to the position of mounting within the ground. This, however, is not the case with respect to the pop-up assemblies provided with part circle patterns. However, because of the provision of the adjustable mounting plate 62, the installation itself of these part circle assemblies can be accomplished in exactly the same manner as the installation of a full circle assembly. Such installation includes merely the threaded engagement of the housing portion 20 onto the upper end of the riser pipe utilizing the appropriate size threads 22 or 24. When the housing has been tightened on the riser pipe to an extent sufficient to achieve a firm mounting and a water-tight seal, it will be noted that the angular position of the pattern most likely will be improperly angularly oriented with respect to the ground. The provision of the adjusting member 62 enables the operator to properly orient the pattern plate with respect to the housing and hence with respect to the ground while the particular assembly is in operation. This greatly facilitates the installation of a system.

It will be noted that the two seals 68 and 81 engaged with the mounting member 62 define the extent of the surface area of the mounting member 62 subject to the operating pressure conditions. Since seal 81 is of lesser diameter than seal 68, the force created by the operating water pressure acting on the exposed annular surface area of the member 62 is applied upwardly. The mounting member is thus pressure biased upwardly which bias is, in turn, transmitted to the pattern plate 70 resulting in an upward pressure bias of the pattern plate into engagement with the lower surface of the rotary head member 84. This pressure bias materially enhances the sealing characteristics between the plate 70 and head member 84 and automatically compensates for wear.

The operation of the pop-up sprinkler assembly 10 is accomplished by simply communicating water under pressure with the inlet 40 of the housing structure 12. This water under pressure fills the interior of the housing structure and rises therein until seal 28 is contacted, at which point the pop-up sprinkler head structure 14 begins to rise against the action of spring 30 until it reaches its fully elevated operative position with the piston member 32 in sealed relation with the seal 28 in accordance with the teachings contained in U.S. Pat. No. 3,921,910. Water is then forced to pass through the strainer 46 into the swirl imparting passages 44. The swirling movement imparted to the water issuing from passages 44 is transmitted to the impeller 48 which causes the latter to rotate as the water flows thereby and upwardly between the exterior periphery of the casing 52 and the interior periphery of the piston member 32. The rotary motion of the impeller 48 is transmitted to the internal drive unit 50 which has the effect of rotating the output shaft 54 with a reduced relatively slow rpm. By virtue of the splined connection of the rotary head member 84 with the output shaft 54, the formed is slowly rotated about the axis of the shaft. Pattern plate 70 is fixedly retained in position below the slowly turning rotary head member 84 by virtue of the engagement of notch 76 within projection 78 and the peripheral confinement of the plate by the rim portion 80 of the mounting member 62. Mounting member 62 holds the pattern plate 70 in fixed relation by virtue of the frictional engagement of resilient O-ring 68 with the cylindrical surface 56 of the piston member 32 which, in turn, is keyed to the housing structure 12.

It will also be noted that the engagement of the resilient O-ring 68 with the cylindrical surface 56 provides a water-tight seal preventing the passage of water thereby, thus directing the water upwardly to the annular surface on the under side of the pattern plate, which is bounded interiorly by the output shaft 56 and exteriorly by the seal 81. Since only a segmental portion of this annular surface is open, as indicated at 92, the water communicated with this annular surface will flow only through those passages in the rotary head member 84 which have their inlets 88 communicating with the opening 92. Thus, in the case of the quarter circle pattern plate 70, there will always be two of the 12 inlets 88 in communication with the opening 92 with the adjacent leading inlet being progressively restricted and the adjacent trailing inlet being progressively opened. The operation with respect to any one sprinkler head passage is one in which the inlet 88 of the passage is first progressively opened to water flow and then progressively closed so that during the opened period water issues upwardly and outwardly from the outlet 90 of the passage and falls on the ground in an instantaneous pattern which is moved through an arc of approximately 90°.

It will be understood that when the half circle pattern 94 is utilized, segmental opening 100 provides for continuous communication with five inlets and progressive restriction and opening of the two adjacent leading and trailing inlets. Similarly, with the utilization of the three-quarter circle pattern plate 110, segmental opening 108 provides for continuous communication of eight inlets 88 with the progressive restriction and opening of the adjacent leading and trailing inlets.

It will also be understood that the operation of the pop-up sprinkler assembly 10 when utilized with any of the part circle pattern plates is such as to provide an annular sector where the inlets are blocked so that there are no streams issuing from the outlets into such sector. In this sector the operator is enabled to approach the operating sprinkler head without getting wet and in those instances where the streams issuing from the outlets fall within a pattern area which is out of proper orientation with the desired ground pattern area, the operator can simply grasp the peripheral surface 82 of the adjustable mounting member 62 and turn the same against the yielding friction provided by the compressed O-ring 68. The operator is enabled to visually determine the proper orientation of the streams within the ground pattern area and make adjustments accordingly which therefore provide for final orientation in a very simple and yet effective manner.

It will also be understood that the stream issuing from all outlets can be simultaneously modified by effecting an appropriate incremental indexed movement of the cap member 116 with respect to the rotary head member 84. Such movement can be effected when the head is in its inoperative position shown in FIG. 1 or, in the case where part circle operation is achieved, such adjustment can be accomplished during operation.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. In a pop-up sprinkler assembly of the type including a housing adapted to be installed in the ground for communication with a source of water under pressure and a sprinkler head structure mounted for movement from an inoperative position within said housing into an elevated operative position in response to the communication of a source of water with said housing, said sprinkler head structure including rotary head means mounted for rotational movement about an upright axis, said rotary head means defining at least four passages disposed in annularly spaced relation about said axis, each of said passages having an inlet end for communication with water under pressure and an outlet end defining an upwardly and outwardly extending stream of water when the associated inlet end is communicated with water under pressure, pattern defining plate means fixed in cooperating relation with respect to the inlet ends of said passages, and means operable in response to the flow of water under pressure from said housing through said pattern defining plate means and into the inlet end of at least one of said passages for rotating said head means about its axis of rotation so that the stream of water issuing from the outlet end of each passage into which water flows is moved so as to fall throughout a ground pattern area determined by said pattern defining plate means, the improvement which comprises manually operable means for adjusting the fixed cooperating relation of said pattern defining plate means with respect to said rotary head means so that the orientation of the ground pattern area within which the water streams fall can be easily determined with respect to said housing where the configuration of the pattern area provided requires such orientation.

2. The improvement as defined in claim 1 wherein said manually operable adjusting means comprises an annular mounting member carrying said pattern defining plate means, said mounting member being mounted for frictionally yieldable movement about the upright axis of rotation of said rotary head member.

3. The improvement as defined in claim 2 wherein said sprinkler head structure includes a cylindrical piston member keyed to said housing for sliding vertical movement with respect thereto, said piston member including an upper outlet end having an interior cylindrical surface, said mounting member including a depending cylindrical flange portion rotatably disposed within said interior cylindrical surface, said cylindrical flange portion having an annular groove formed in the exterior periphery thereof and a resilient O-ring mounted in said annular groove in compressed relation to said interior cylindrical surface so as to provide said frictionally yieldable movement.

4. The improvement as defined in claim 3 wherein said pattern defining plate means comprises a flat circular plate and said mounting member includes an upwardly facing annular portion extending radially outwardly from said depending flange portion for receiving said circular plate thereof, said annular portion having an upstanding rim portion thereon for peripherally confining said circular plate.

5. The improvement as defined in claim 4 wherein said mounting member includes a manually engageable peripheral portion extending upwardly from the periphery of said annular portion.

6. The improvement as defined in claim 5 wherein said mounting member includes an interior annular groove at the juncture between said depending cylindrical flange portion and said upwardly facing annular portion, and an annular seal in said interior annular groove disposed in sealing relation with said plate.

7. The improvement as defined in claim 1, 2, 3, 4, 5 or 6 wherein said rotating means includes a driven output shaft extending centrally upwardly through said pattern defining plate means, said rotary head means including a head member fixed to said output shaft through which said passages extend so that the inlet ends thereof extend axially upwardly from the lower surface of said rotary head member and the outlet ends thereof extend in an upward and outward direction to the periphery of said rotary member, and a stream modifying cap member mounted on said rotary member for incremental indexed rotary movements about the axis of rotation thereof, said cap member having formed on the periphery thereof sets of stream engaging depending elements of different vertical extent spaced apart a distance equal to the aforesaid incremental indexed movement of said cap member, said sets being equal in number and spacing to the number and spacing of said passage outlet ends and being arranged so that at each incremental position of indexed movement of said cap member the depending elements aligned with each passage outlet end is of the same vertical extent whereby the stream issuing from each passage outlet end at any indexed position is the same and each is changed in response to an indexed movement of said cap member.

8. The improvement as defined in claim 7 wherein the number of passages is 12.

9. The improvement as defined in claim 4, 5 or 6 wherein said flat plate includes a segmental opening of a predetermined angular extent for communicating the water under pressure with a predetermined number of said passages.

10. The improvement as defined in claim 9 wherein said predetermined angular extent is approximately 85°.

11. The improvement as defined in claim 9 wherein said predetermined angular extent is approximately 175°.

12. The improvement as defined in claim 9 wherein said predetermined angular extent is approximately 265°.

13. In a sprinkler including housing means for communication with a source of water under pressure, rotary head means mounted on said housing means for rotational movement about an upright axis, said rotary head means defining at least four passages disposed in annularly spaced relation about said axis, each of said passages having an inlet end for communication with water under pressure and an outlet end defining an upwardly and outwardly extending stream of water when the associated inlet end is communicated with water under pressure, pattern defining plate means fixed in cooperating relation with respect to the inlet ends of said passages, and means operable in response to the flow of water under pressure from said housing means through said pattern defining plate means and into the inlet end of at least one of said passages for rotating said head means about its axis of rotation so that the stream of water issuing from the outlet end of each passage into which water flows is moved so as to fall throughout a ground pattern area determined by said pattern defining plate means, the improvement which comprises manually operable means for adjusting the fixed cooperating relation of said pattern defining plate means with respect to said rotary head means so that the orientation of the ground pattern area within which the water streams fall can be easily determined with respect to said housing means where the configuration of the pattern area provided requires such orientation.

14. In a sprinkler including an annular head member having at least four water flow passages extending therethrough so that the outlet ends thereof extend in an upward and outward direction to the periphery of said head member in equal annularly spaced relation, the improvement which comprises a stream modifying cap member mounted on said head member for incremental indexed rotary movements about an upright axis of rotation, said cap member having formed on the periphery thereof sets of stream engaging depending elements of different vertical extent spaced apart a distance equal to the aforesaid incremental indexed movement of said cap member, said sets being equal in number and spacing to the number and spacing of said passage outlet ends and being arranged so that at each incremental position of indexed movement of said cap member the depending elements aligned with each passage outlet end is of the same vertical extent whereby the stream issuing from each passage outlet end at any indexed position is the same and each is changed in response to an indexed movement of said cap member.

15. The improvement as defined in claim 14 wherein each of said sets includes four stream engaging depending elements.

16. The improvement as defined in claim 15 wherein the number of sets is twelve.

17. The improvement as defined in claim 14, 15 or 16 wherein there is a space between each set of stream engaging elements which when aligned with an associated passage outlet end permits the associated stream to issue therefrom unobstructed.

18. In a sprinkler including housing means for communication with a source of water under pressure, rotary head means mounted on said housing means for rotational movement about an upright axis, said rotary head means defining at least four passages disposed in annularly spaced relation about said axis, each of said passages having an inlet end for communication with water under pressure and an outlet end defining an upwardly and outwardly extending stream of water when the associated inlet end is communicated with water under pressure, a pattern plate operatively fixed in cooperating engagement with said rotary head means and having pattern defining opening means therein operable to communicate water under pressure within said housing means with the inlet ends of said passages, and means operable in response to the flow of water under pressure from said housing means through said pattern defining opening means and into the inlet end of at least one of said passages for rotating said head means about its axis of rotation so that the stream of water issuing from the outlet end of each passage into which water flows is moved so as to fall throughout a ground pattern area determined by said pattern plate means, the improvement which comprises a rigid annular member supportingly sealingly engaging said pattern plate in operatively fixed relation therewith and means mounting said rigid annular member within said housing means so that operative pressure conditions therein create a resultant hydraulic force acting on said rigid annular member in a direction to be transmitted to said pattern plate and to thereby pressure bias the pattern plate into sealed engagement with said rotary head means.

19. In a pop-up sprinkler assembly of the type including a housing adapted to be installed in the ground for communication with a source of water under pressure and a sprinkler head structure mounted for movement from an inoperative position within said housing into an elevated operative position in response to the communication of a source of water with said housing, said sprinkler head structure including rotary head means mounted for rotational movement about an upright axis, said rotary head means defining at least four passages disposed in annularly spaced relation about said axis, each of said passages having an inlet end for communication with water under pressure and an outlet end defining an upwardly and outwardly extending stream of water when the associated inlet end is communicated with water under pressure, a pattern place operatively fixed in cooperating engagement with said rotary head means and having pattern defining opening means therein operable to communicate water under pressure within said housing with the inlet ends of said passages, and means operable in response to the flow of water under pressure from said housing through said pattern defining opening means and into the inlet end of at least one of said passages for rotating said head means about its axis of rotation so that the stream of water issuing from the outlet end of each passage into which water flows is moved so as to fall throughout a ground pattern area determined by said pattern plate means, the improvement which comprises a rigid annular member supportingly sealingly engaging said pattern plate in operatively fixed relation therewith and means mounting said rigid annular member within said housing means so that operative pressure conditions therein create a resultant hydraulic force acting on said rigid annular member in a direction to be transmitted to said pattern plate and to thereby pressure bias the pattern plate into said engagement with said rotary head means.

20. The improvement as defined in claim 19 wherein said sprinkler head structure includes a cylindrical piston member keyed to said housing for sliding vertical movement with respect thereto, said piston member including an upper outlet end having an interior cylindrical surface, said rigid annular member including a depending cylindrical flange portion disposed within said interior cylindrical surface, said cylindrical flange portion having an annular groove formed in the exterior periphery thereof and a resilient O-ring mounted in said annular groove in sealed relation to said interior cylindrical surface.

21. The improvement as defined in claim 20 wherein said pattern plate is flat and circular and said rigid annular member includes an upwardly facing annular portion extending radially outwardly from said depending flange portion for receiving said circular plate thereon, said annular portion having an upstanding rim portion thereon for peripherally confining said circular plate.

22. The improvement as defined in claim 21 wherein said mounting member includes an interior annular groove at the juncture between said depending cylindrical flange portion and said upwardly facing annular portion, and an annular seal of a diameter less than the diameter of said O-ring in said interior annular groove disposed in sealing relation with said plate.

* * * * *